US009540917B2

(12) United States Patent
Stone et al.

(10) Patent No.: US 9,540,917 B2
(45) Date of Patent: Jan. 10, 2017

(54) HYDROCARBON RECOVERY EMPLOYING AN INJECTION WELL AND A PRODUCTION WELL HAVING MULTIPLE TUBING STRINGS WITH ACTIVE FEEDBACK CONTROL

(75) Inventors: Terry Wayne Stone, Kings Worthy (GB); George A. Brown, Beaconsfield (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 518 days.

(21) Appl. No.: 14/238,861

(22) PCT Filed: Aug. 8, 2012

(86) PCT No.: PCT/US2012/050018

§ 371 (c)(1),
(2), (4) Date: Feb. 14, 2014

(87) PCT Pub. No.: WO2013/025420

PCT Pub. Date: Feb. 21, 2013

(65) Prior Publication Data

US 2014/0166280 A1 Jun. 19, 2014

Related U.S. Application Data

(60) Provisional application No. 61/523,985, filed on Aug. 16, 2011.

(51) Int. Cl.
*G05D 7/00* (2006.01)
*E21B 43/24* (2006.01)
(Continued)

(52) U.S. Cl.
CPC ..... *E21B 43/2408* (2013.01); *E21B 43/12* (2013.01); *E21B 43/2406* (2013.01); *E21B 44/00* (2013.01)

(58) Field of Classification Search
CPC ..... E21B 43/2408
(Continued)

(56) References Cited

U.S. PATENT DOCUMENTS 4,086,960 A * 5/1978 Haynes ..... E21B 36/02 166/260
4,694,907 A * 9/1987 Stahl ..... F22B 1/287 166/303
(Continued)

FOREIGN PATENT DOCUMENTS

WO 2011073952 A2 6/2011

OTHER PUBLICATIONS

Rangel-German, E. R., et al. "Electrical-heating-assisted recovery for heavy oil." Journal of Petroleum Science and Engineering 45.3 (2004): pp. 213-231.*
(Continued)

*Primary Examiner* — Satish Rampuria
(74) *Attorney, Agent, or Firm* — Colin L. Wier; Rodney Warfford; Alec McGinn

(57) ABSTRACT

System and method for producing fluids from a hydrocarbon reservoir where an injector well segment and parallel underlying producer well segment are both completed with slotted liners. The injector and producer segments are logically partitioned into corresponding sections to define a plurality of injector-producer section pairs. Injection tubing strings supply stimulating fluid (e.g., saturated steam) to associated sections of the injector segment for injection into the hydrocarbon reservoir. Surface-located control devices control the pressure of the stimulating fluid flowing through the respective injection tubing strings. Production tubing strings (with the aid of artificial lift) carry fluids produced from associated sections of the producer segment. A plurality of controllers is provided for the injector-producer section pairs to control
(Continued)

at least one process variable (e.g., interwell subcool temperature) associated with respective injector-producer section pairs over time by adjusting control variables that dictate operation of the control devices for the injection tubing strings.

27 Claims, 5 Drawing Sheets

(51) Int. Cl.
*E21B 43/12* (2006.01)
*E21B 44/00* (2006.01)

(58) Field of Classification Search
USPC ..... 700/275–306
See application file for complete search history.

(56) References Cited

U.S. PATENT DOCUMENTS 4,765,407 A * 8/1988 Yuvancic ..... E21B 43/164 166/266
5,127,457 A * 7/1992 Stewart ..... E21B 36/00 166/279
6,871,118 B2 * 3/2005 Henriot ..... E21B 49/00 422/50
2003/0141073 A1 * 7/2003 Kelley ..... E21B 43/122 166/372
2009/0188661 A1 7/2009 Bizon
2011/0283705 A1 * 11/2011 Oliver ..... F42D 3/00 60/698

OTHER PUBLICATIONS

Ma, Zhiwei, et al. "Practical implementation of knowledge-based approaches for steam-assisted gravity drainage production analysis." Expert Systems with Applications 42.21 (2015): pp. 7326-7343.*
Babadagli, Tayfun. "Evaluation of EOR methods for heavy-oil recovery in naturally fractured reservoirs." Journal of Petroleum Science and Engineering 37.1 (2003): pp. 25-37.*
Weaver, et al., "Installation and Application of Permanent Downhole Optical Pressure/Temperature Gauges and Distributed Temperature Sensing in Producing Deepwater Wells at Marco Polo", SPE 95798—SPE Annual Technical Conference and Exhibition, Dallas, Texas, Oct. 9-12, 2005, pp. 1-10.
Brown, G.,"Therma 5.0 User Reference Manual", Feb. 2012, pp. 29, 81.
Caranahan, et al., "Fiber Optic Temperature Monitoring Technology", SPE 54599—SPE Annual Technical Conference and Exhibition, Anchorage, Alaska, May 26-28, 1999.
Chen, et al., "Effects of Reservoir Heterogeneities on the Steam-Assisted Gravity", SPE 109873—SPE Annual Technical Conference and Exhibition, Anaheim, California, Nov. 11-14, 2007.
Cokar, et al., "Optimization of SAGD Wellbore Completions: Short-Production-Tubing-String Sensitiviteis", SPE 117854—SPE Production & Operations, vol. 25 (1), Feb. 2010, pp. 50-58.
Debaun, et al., "An Extensible Architecture for Next Generation Scalable Parallel Reservoir Simulation", SPE 93274—SPE Reservoir Simulation Symposium, Houston, Texas, 2005, pp. 1-13.
Gates, et al., "Optimization of Steam Assisted Gravity Drainage in McMurray Reservoir", Journal of Canadian Petroleum Technology, vol. 45 (9), 2006, pp. 1-9.
Gates, et al., "Steam-Injection Strategy and Energetics of Steam-Assisted Gravity Drainage", SPE 97742—SPE Reservoir Evaluation & Engineering, vol. 10(1), Nov. 1-3, 2005, pp. 19-34.
Gotawala, et al., "SAGD Subcool Control with Smart Injection Wells", SPE 122014—EUROPEC/EAGE Conference and Exhibition, Amsterdam, The Netherlands, Jun. 8-11, 2009, pp. 1-13.
Güyagüler, et al., "Feedback Controllers for the Simulation of Field Processes", SPE 118969—SPE Evaluation & Engineering, vol. 13 (1), 2010, pp. 1-18.
Handfield, et al., "SAGD Gas Lift Completions and Optimization: A Field Case Study at Surmont", SPE 117489—Journal of Canadian Petroleum Technology, vol. 48 (11), Nov. 2009, pp. 51-54.
Holmes, et al., "A Unified Wellbore Model for Reservoir Simulation", SPE 134928—SPE Annual Technical Conference and Exhibition, Florence, Italy, Sep. 19-22, 2010, pp. 1-14.
Holmes, Jonathan A., "Modeling Advanced Wells in Reservoir Simulation", SPE 72493—Distinguished Author Series, Journal of Petroleum Technology, Nov. 2001, pp. 54-66.
Krawchuk, et al., "Predicting the flow distribution on Total E&P Canada's Joslyn project horizontal SAGD producing wells using permanently installed fiber optic monitoring", SPE 102159—SPE Annual Technical Conference and Exhibition, San Antonio, Texas, Sep. 24-27, 2006, pp. 1-14.
Prats, M., "WellWatcher BriteBlue HT, High-Temperature, Harsh Environment Multimode Fiber", Thermal Recovery. SPE Monograph Series vol. 7, Society of Petroleum Engineers, New York, Schlumberger WellWatcher BriteBlue HT product specification, 2011.
Shi, et al., "A General Unstructured Grid, Parallel, Fully Implicit Thermal Simulator and Its Application for Large Scale Thermal Models", SPE 119172—SPE Reservoir Simulation Symposium, The Woodlands, Texas, Feb. 2-4, 2009, pp. 1-8.
Stone, et al., "A Unified Thermal Wellbore Model for Flexible Simulation of Multiple Tubing Strings", SPE 142153—SPE Reservoir Simulation Symposium, The Woodlands, Texas, Feb. 21-23, 2011.
Stone, et al., "Dynamic and Static Thermal Well Flow Control Simulation", SPE 130499—SPE EUROPEC/EAGE Annual Conference and Exhibition, Barcelona, Spain, Jun. 14-17, 2010.
Stone, et al., "Dynamic SAGD Well Flow Control Simulation", CSUG/SPE-138054—Canadian Unconventional Resources & International Petroleum Conference, Calgary, Alberta, Canada, Oct. 19-21, 2010.
Stone, et al., "Thermal Simulation With Multisegment Wells", SPE 66373—SPE Reservoir Simulation Symposium, Houston, Texas, Feb. 4-11, 2001, pp. 1-13.

* cited by examiner

Time = $T_1$

Time = $T_2$

HYDROCARBON RECOVERY EMPLOYING AN INJECTION WELL AND A PRODUCTION WELL HAVING MULTIPLE TUBING STRINGS WITH ACTIVE FEEDBACK CONTROL

BACKGROUND

Field

The present application relates broadly to systems and methods of hydrocarbon recovery employing an injection well to inject fluids into a subterranean formation and a production well to produce hydrocarbons from the subterranean formation. More particularly, the present application relates to such systems and methods where the injection well and the production well employ multiple tubing strings.

Description of Related Art

There are many petroleum-bearing formations from which oil cannot be recovered by conventional means because the oil is so viscous that it will not flow from the formation to a conventional oil well. Examples of such formations are the bitumen deposits in Canada and the United States and the heavy oil deposits in Canada, the United States, and Venezuela. In these deposits, the oil is so viscous under the prevailing temperatures and pressures within the formations that it flows very slowly (or not at all) in response to the force of gravity. Heavy oil is an asphaltic, dense (low API gravity) and viscous oil that is chemically characterized by asphaltene content. Most heavy oil is found at the margins of geological basins and is thought to be the residue of formerly light oil that has lost its light molecular weight components through degradation by bacteria, water-washing, and evaporation.

In a steam assisted gravity drainage (SAGD) process, heavy oil is typically recovered by injecting saturated steam into the heavy oil reservoir utilizing one or more horizontal injection wells. The injection process produces a steam chamber within the reservoir. At the edges of the steam chamber, heat transfer is accomplished by the condensation of steam and conductive heat transfer, which reduces the viscosity of the heavy oil in this region and allows it to flow downward by gravity drainage. A horizontal production well is located below the horizontal injection well. The steam is typically injected into the reservoir for a period of time prior to production and continuously during production. Mobilized oil and condensed steam flows to the lower horizontal production well, where it is pumped by artificial lift (e.g., gas lift, progressing cavity pump, electrical submersible pump (ESP)) to the surface.

A necessary condition for efficient recovery of the heavy oil in a SAGD operation is the creation of a uniform steam chamber along the length of the horizontal injection well. If only a fraction of the heavy oil surrounding the injection well is heated, then only a fraction of the surrounding heavy oil will be mobilized. The efficiency of steam utilization can be aided by maintaining a cooler region nearer the production wellbore to discourage escape of steam from the steam chamber. This is often referred to as steam-trap control. In field practice, the continued existence of the liquid pool is monitored by examining the temperature difference between the injected steam and produced fluids, called the interwell subcool or subcool temperature. The 2005 publication by Gates et al. entitled "Steam-Injection Strategy and Energetics of Steam-Assisted Gravity Drainage," SPE/PS-CIM/CHOA 97742 presented at the 2005 SPE International Thermal Operations and Heavy Oil Symposium, Calgary, Alberta, Canada, 1-3 Nov. 2005, describes maintaining the interwell subcool temperature at a temperature between 15 and 30° C.

The 2009 publication by Gotawala and Gates entitled "SAGD Subcool Control with Smart Injection Wells," SPE 122014, Jun. 8, 2009 evaluated the use of Proportional-Integral-Derivative (PID) feedback control of inflow control valve (ICV) settings to control steam injection pressures along a set of six intervals of a horizontal injector well to promote subcool temperatures of the six intervals to be within a specified value. In this paper, the ICVs are intelligent completion equipment that are located downhole in the horizontal injection well and distributed over the horizontal injection well to allow for the control of steam injection rates along six intervals of the horizontal injection well. Subcool temperatures over these six intervals of the injection well and corresponding intervals of the lower production well were considered, each with its own steam injection rate dictated by a downhole ICV. The PID feedback control of the downhole ICVs changed the steam injection rate for each interval by modeling each ICV as a separate well and adjusting the steam injection pressure in each well in order to promote a subcool target over the six intervals of the injection well and production well. This enabled more uniform steam chamber growth, resulting in more oil production with reduced steam injection.

SAGD operations with wells incorporating inflow control devices (ICDs) and flow control valves (FCVs) under feedback control, looped multi-segment well topology and pressure/rate control at several points internal to the wellbore have been discussed in Stone et al, "Dynamic and Static Thermal Well Flow Control Simulation," SPE 130499, Jun. 14, 2010, and Stone et al., "Dynamic SAGD Well Flow Control Simulation," SPE 138054, Oct. 19, 2010. The multi-segment well topologies include a dual-tubing configuration for the injection well and the production well as shown in FIG. 1. Such a dual-tubing configuration is described in Handfield et al, "SAGD Gas Lift Completions and Optimization: A Field Case Study at Surmont," SPE 117489, Journal of Canadian Petroleum Technology, Volume 48, No. 11, November 2009.

SUMMARY

A system and method is provided for producing fluids from a subterranean hydrocarbon reservoir traversed by an injection well and a production well. The injection well includes a segment (referred to as the injector segment) that is completed with one or more slotted liners. The injector segment is isolated from other parts of the injection well. The production well includes a segment (referred to as the producing segment) that is completed with one or more slotted liners. The producing segment is isolated from other parts of the production well. The injector segment of the injection well is positioned in the hydrocarbon reservoir above and generally parallel to the producing segment of the production well. The injector segment of the injection well is logically partitioned into a number of sections (for example, a heel section and a toe section), and the producing segment of the production well is logically partitioned into a number of sections (for example, a heel section and a toe section) that correspond to the sections of the injector segment (i.e., a given section of the producing segment may lie under the corresponding section of the injector segment). The pairs of corresponding sections of the injector segment and the producing segment are referred to herein as "injector-producer section pairs" or "section pairs." For example, the heel section of the injector segment and the heel section of the producing segment can be referred to as an injector-producer section pair or injector-producer heel section pair, and the toe section of the injector segment and the toe section of the producing segment can also be referred to as an injector-producer section pair or injector-producer toe section pair.

A number of injection tubing strings are provided for the sections of the injector segment. Each injection tubing string is configured to supply stimulating fluid (such as saturated steam) to an associated section of the injector segment where the stimulating fluid flows through the interior space defined by the slotted liner(s) of the injector segment and exits through the slotted liner(s) into the hydrocarbon reservoir. The steam may or may not exit into the reservoir in the vicinity of the injector segment of the injection well. The injection tubing strings extend from the surface through the injection well and terminate at internal locations of the injection well that are spaced apart from one another within an associated section of the injector segment of the injection well. For example, in one embodiment, one injection tubing string that supplies stimulating fluid to the heel section of the injector segment terminates at an internal location of the injection well which is at or near the proximal end of the heel section of the injector segment, and another injection tubing string that supplies stimulating fluid to the toe section of the injector segment terminates at an internal location of the injection well which is at or near the distal end of the toe section of the injector segment. A number of surface-located control chokes are provided to control the tubing head pressure of the stimulating fluid flowing through the respective injector tubing strings in order to regulate the flow of stimulating fluid flowing through the injection tubing strings.

A number of production tubing strings are provided for the sections of the producing segment. Each production tubing string is configured to carry fluids produced from an associated section of the producing segment of the production well. The production tubing strings extend from the surface through the production well and terminate at internal locations of the production well that are spaced apart from one another within an associated section of the producing segment of the production well. For example, in one embodiment, one production tubing string that carries fluids produced from the heel section of the producing segment terminates at an internal location of the production well which is at or near the proximal end of the heel section of the producing segment, and another producing tubing string that carries fluids produced from the toe section of the producing segment terminates at an internal location of the production well which is at or near the distal end of the toe section of the producing segment.

A plurality of controllers is provided for the injector-producer section pairs. Each controller is configured to control at least one process variable for one of the injector-producer section pairs over a time interval. Each given controller calculates an error value associated with the at least one process variable of the corresponding injector-producer section pair over a time interval. The error value is used in a control function processed by the given controller, wherein the control function is configured to minimize the error value over the time interval by adjusting a control variable over time. The adjusted control variable is used to control the surface-located control device for the injector tubing string that supplies stimulating fluid to the injector section of the associated injector-producer section pair.

In one embodiment, the control function of each given controller includes a first term, a second term, and a third term. The first term produces an output value that is proportional to the current error value. The second term produces an output value that is proportional to the integral of the error value over a time interval. The third term produces an output value that is proportional to the derivative of the error value with respect to time at a given time. At the beginning of a time interval during which each controller operates, each controller can be reset such that the first error term of that controller, the second integral term of that controller and the third derivative term of that controller are all set to 0. These time intervals are defined depending on whether (i) a process variable has previously exceeded a user-defined maximum or minimum value and is now ready to operate within a user-specified range of values, or (ii) an injector-producer section pair boundary is redefined.

In one embodiment, the error value calculated by each given controller is based upon a calculation wherein a target subcool temperature is subtracted from a process variable representing a measured interwell subcool temperature.

The boundaries of the injector-producer section pairs may change in time. Also, for certain time intervals, these boundaries may merge. These boundaries can be chosen by the operator. In each of the injector-producer sections, the actual subcool is calculated by averaging temperatures in the injector length of the section, and then subtracting an average temperature of produced fluids in the producer length of this section. The operator may wish to change the lengths of the sections or to merge them in order to concentrate the injection to correct a stubborn problem with either subcool, water cut or other measured quantity that is being used in the error term of the controller.

In one embodiment, the injection tubing strings are configured to supply saturated steam to the associated sections of the injector segment where it exits through the slotted liner(s) of the injector segment into a heavy oil reservoir in the vicinity of the injector segment of the injection well. Note that the ability of steam to exit anywhere along the injector segment depends completely on the mobility of fluids in the reservoir. For example, if steam is being supplied only to an injection tubing string that is landed at the distal end of the injection well, perhaps somewhere near the toe section of the injector segment of that well, but the mobility of the reservoir fluids outside the slotted liner in the vicinity of the toe section of the injector segment is low whereas the mobility of reservoir fluids in the region of another injector-producer section is higher, perhaps nearer to the heel, then steam will exit from the well through the slotted liner into the reservoir in this other section corresponding to higher mobility of reservoir fluids.

The error values for the interwell subcool temperature of the associated injector-producer section pairs can be based on a number of temperature measurements distributed over the corresponding sections of the producing segment. These temperature measurements can be provided by an array of temperature sensors (e.g., a multiple bundle thermocouple), a fiber optic distributed temperature sensor, or other suitable temperature sensors along the entire length (or partial length) of the producing segment.

The error values for the interwell subcool temperature of the associated injector-producer section pairs can be based on a number of temperature measurements distributed over the corresponding sections of the injector segment. These temperature measurements can be provided by an array of temperature sensors (e.g., a multiple bundle thermocouple), a fiber optic distributed temperature sensor, or other suitable temperature sensors along the entire length (or partial length) of the injector segment.

The error values for the interwell subcool temperature of the associated injector-producer section pairs can be based on a number of pressure measurements distributed over the corresponding sections of the injector segment. These pressure measurements can be provided by an array of pressure sensors (e.g., bubble tubes or quartz transducers), a fiber optic distributed pressure sensor, or other suitable pressure sensors along the entire length (or partial length) of the injector segment.

Both the injector segment of the injection well and the producing segment of the production well can extend generally in respective parallel horizontal directions with the producing segment below the injector segment. Alternatively, the injector segment of the injection well can extend generally in a horizontal direction and the producing segment of the production well can extend in an inclined manner under the injector segment of the injection well.

Both the injector segment of the injection well and the producing segment of the production well can extend by lateral branches from the main stem in the same fashion as described above. Within any lateral branch or the main stem, controllers may be set up as described above.

In one embodiment, the control functions of the respective controllers have the form:

$$IR = IR_{t_s} + K_p\left(e(t) + \frac{\int_{t_s}^{t_e} e(t)\,dt}{T_i} - T_d\frac{d}{dt}e(t)\right)$$

where IR is a control variable that is used to control the steam injection rate with a surface-located control device for associated injector tubing;

$IR_{t_s}$ is an initial state of the control variable IR;

$K_p e(t)$ is the first term, where $K_p$ is a proportionality constant for all the terms in the controller;

$$\frac{K_p\int_{t_s}^{t_e} e(t)\,dt}{T_i}$$

is the second term, where $T_i$ is an integral time constant for the second term;

$$-K_p T_d\frac{d}{dt}e(t)$$

is the third term, where $-T_d$ is a derivative time constant for the third term; and e(t) is the error value of the control function at a given time, and represents the difference between the interwell subcool temperature of an associated injector-producer section pair and a target subcool temperature value at a given time.

It is possible, and may be desirable, to include other terms related to other process variables besides interwell subcool in the controller error term as described above. For example, for the controller operating in a particular injector-producer section pair, the error term could include the difference between a measured and target subcool as well as a water cut, gas-oil ratio (GOR), and/or steam-oil ratio (SOR). The target for these last two terms, i.e. the water cut and GOR/SOR, would be zero. Each of these terms, i.e. the interwell subcool less the target subcool, the water cut and GOR/SOR could be multiplied by a weighting factor in order to make up the error term in the controller. With the inclusion of these other terms, the controller would still operate as described herein.

DETAILED DESCRIPTION

As used herein, the term "distal" in referring to a portion of a well means situated away from the earth surface along the inside of the borehole of the well, while the term "proximal" in referring to a portion of a well means situated near to the earth surface along the inside of the borehole of the well.

Figure 1:
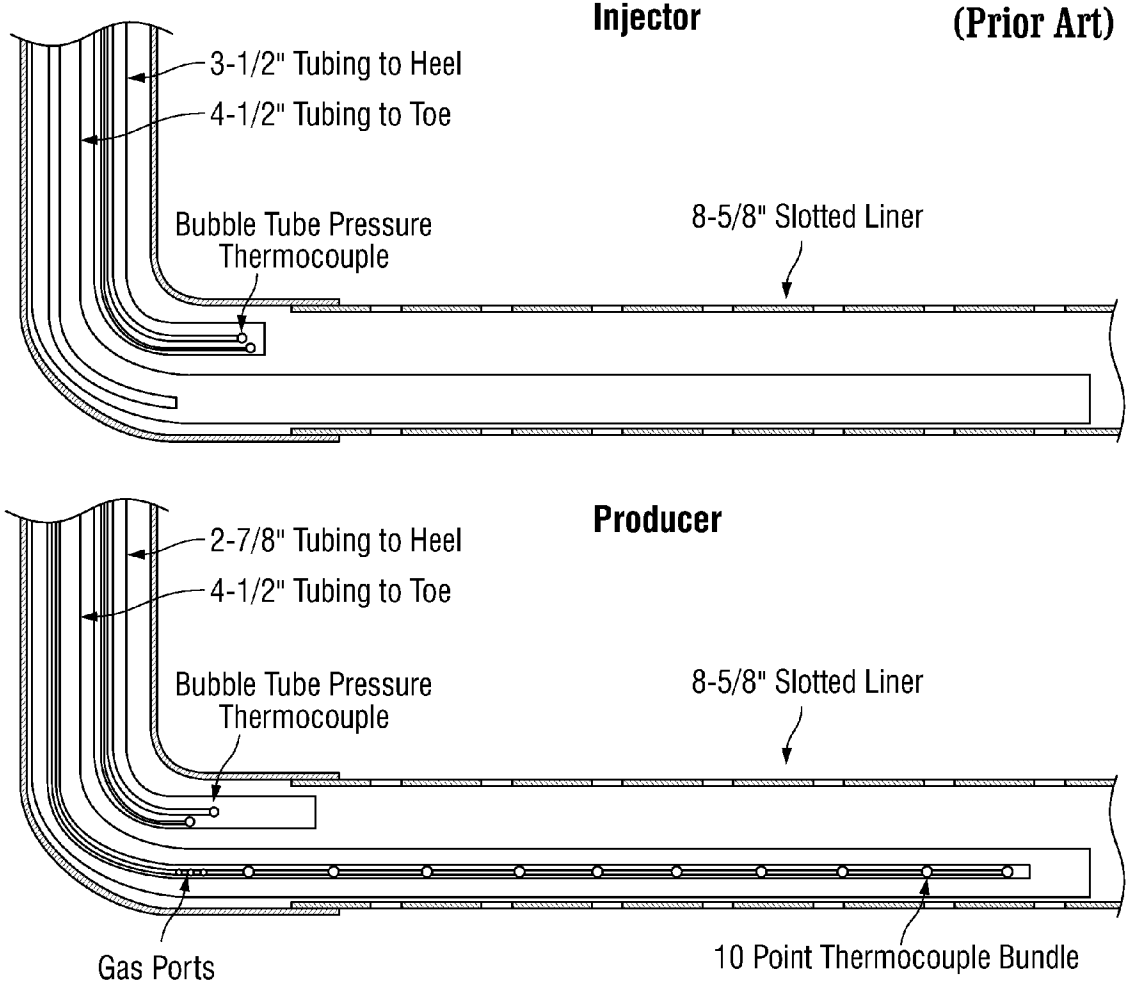
FIG. 1 (Prior Art)
FIG. 1 is a schematic diagram of a prior art SAGD system for producing hydrocarbons from a subterranean heavy oil reservoir.
Figure 2:
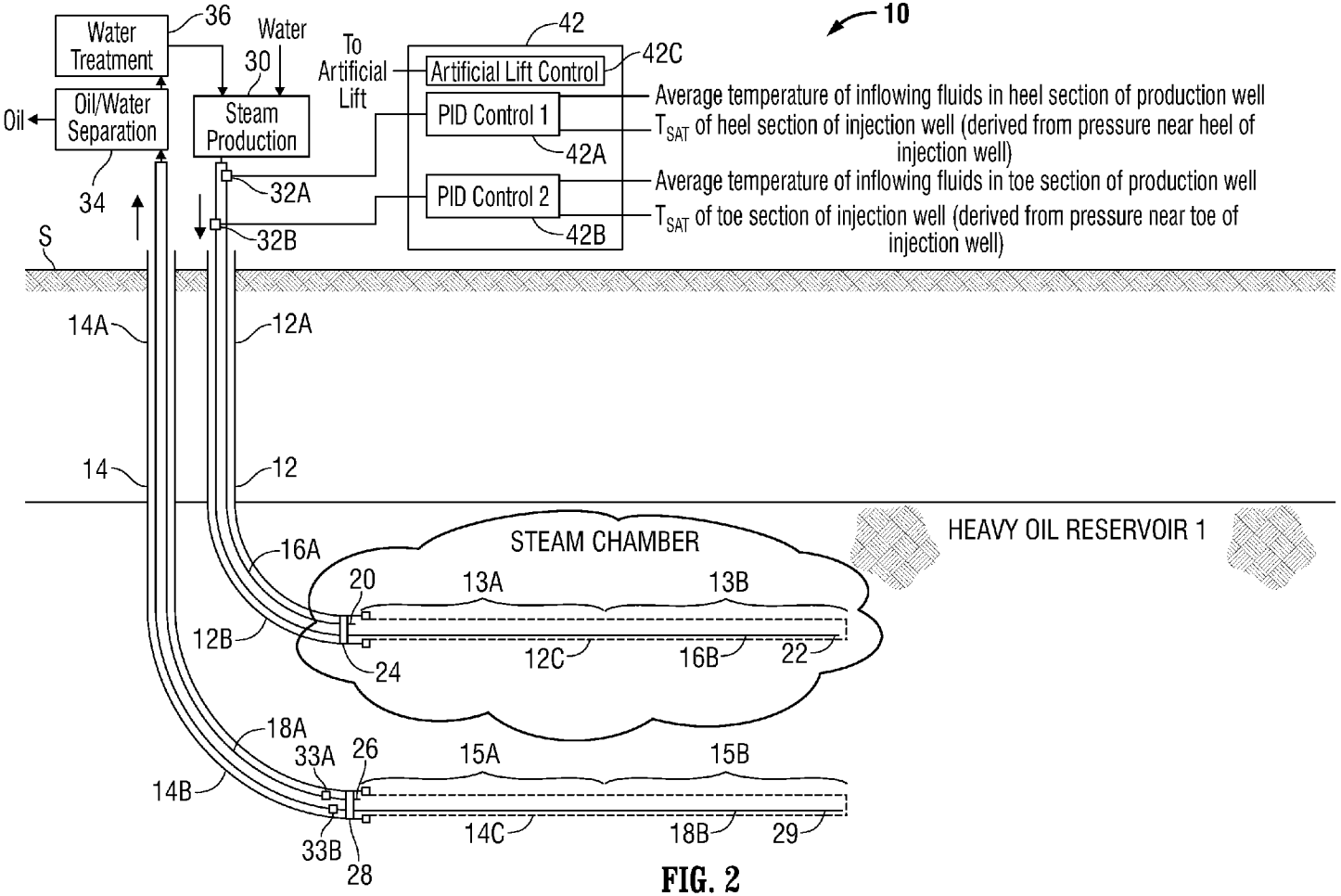
FIG. 2 is a schematic diagram of an illustrative embodiment of a SAGD system for producing hydrocarbons from a subterranean heavy oil reservoir 1 in accordance with the present application.

Turning to FIG. 2, there is shown a schematic diagram of an illustrative embodiment of a SAGD system 10 for producing hydrocarbons from a subterranean heavy oil reservoir 1. The system 10 includes an injection well 12 with a vertical portion 12A, a curved portion 12B, and a "horizontal" portion 12C. In all following discussion, "horizontal" refers to a portion of the well that is approximately horizontal but, in reality, undulates with an axial angular deviation that may be as high as +−5 degrees. It also includes a production well 14 with a vertical portion 14A, a curved portion 14B, and a horizontal portion 14C. Both the curved portion 14B and the horizontal portion 14C of the production well 14 are located below the curved portion 12B and the horizontal portion 12C of the injection well 12. The horizontal portion 12C of the injection well 12 is completed with a slotted liner which is shown schematically by broken lines in FIG. 2. The slotted liner of the horizontal portion 12C is machined with multiple longitudinal slots distributed across its length and circumference. The slots provide for fluid communication between the inside of the horizontal portion 12C and the formation. The slotted liner is put in place without any cement and prevents the borehole wall from collapsing. A screen (such as gravel or mesh backed by a grid) can be placed between the slotted liner and the borehole wall to provide a sand filter therebetween. The horizontal portion 12C is isolated from other parts of the injection well 12 by suitable completion equipment (such as a packer 24). The horizontal portion 14C of the production well 14 is completed with a slotted liner which is shown schematically by broken lines in FIG. 2. The slotted liner of the horizontal portion 14C is machined with multiple longitudinal slots distributed across its length and circumference. The slots provide for fluid communication between the inside of the horizontal portion 14C and the formation. The slotted liner is put in place without any cement and prevents the borehole wall from collapsing. A screen (such as gravel or mesh backed by a grid) can be placed between the slotted liner and the borehole wall to provide a sand filter therebetween. The horizontal portion 14C is isolated from other parts of the production well 14 by suitable completion equipment (such as a packer 28).

The horizontal portion 12C of the injection well 12 is logically partitioned into a heel section 13A and a toe section 13B as shown in FIG. 2. The heel section 13A begins at the proximal end of the slotted liner of the horizontal portion 12C after the packer 24 and ends at or near the mid-point of the slotted liner of the horizontal portion 12C. The toe section 13B begins at or near the mid-point of the slotted liner of the horizontal portion 12C (i.e., the end of the heel section 13A) and ends at or near the distal end of the slotted liner of the horizontal portion 12C. Similarly, the horizontal portion 14C of the production well is logically partitioned into a heel section 15A and a toe section 15B as shown in FIG. 2. The heel section 15A and toe section 15B correspond to the heel section 13A and toe section 13B of the injector segment (i.e., a given section of the producing segment lies under the corresponding section of the injector segment). Thus, the heel section 13A of the horizontal injector portion 12C and the heel section 15A of the horizontal producing portion 14C can be referred to as an injector-producer section pair, and the toe section 13B of the horizontal injector portion 12C and the toe section 15B of the horizontal producing portion 14C can also be referred to as an injector-producer section pair.

A short tubing string 16A and a long tubing string 16B extend from the surface S through the injection well 12. The tubing strings 16A, 16B can be coiled tubing, production tubing, or other tubular used in a well. The distal (outlet) end 20 of the short tubing string 16A is located within the interior of the injection well 12 proximal to and near the proximal end of the slotted liner of the horizontal portion 12C of the injection well. Note that short tubing string 16A can land almost anywhere along the length of the injection well 12. In fact, the short tubing string 16A may be pushed-pulled by the operator for various reasons. The distal (outlet) end 22 of the long tubing string 16B is located within the interior of the injection well 12 at or near the distal end (toe) of the slotted liner of the horizontal portion 12C. A packer 24 can be disposed in the injection well 12 proximal to the distal end 20 of the short tubing string 16A in order to isolate the horizontal portion 12C of the injection well 12 from the other parts of the injection well 12 that are disposed proximal to the packer 24 to enable controlled injection to the horizontal portion 12C. In one embodiment, the short tubing string 16A has a smaller diameter than the long tubing string 16B.

A short tubing string 18A and a long tubing string 18B extend from the surface S through the production well 14. The tubing strings 18A, 18B can be coiled tubing, production tubing or other tubular used in a well. The distal (inlet) end 26 of the short tubing string 18A is located within the interior of the production well 14 proximal to and near the proximal end of the slotted liner of the horizontal portion 14C. Note that short tubing string 18A can land almost anywhere along the length of the production well 14. In fact, the short tubing string 18A may be pushed-pulled by the operator for various reasons. The distal (inlet) end 29 of the long tubing string 18B is located within the interior of the production well 14 at or near the distal end (toe) of the slotted liner of the horizontal portion 14C. A packer 28 can be disposed in the production well 14 proximal to the distal end 26 of the short tubing string 18A in order to isolate the horizontal portion 14C of the production well 14 from the other parts of the production well 14 that are disposed proximal to the packer 28 to enable controlled production from the horizontal portion 14C. In one embodiment, the short tubing string 18A has a smaller diameter than the long tubing string 18B.

The system 10 further includes a steam production facility 30 that vaporizes water into steam and supplies the steam under pressure to the short tubing string 16A and the long tubing string 16B via corresponding surface-located control chokes 32A, 32B, respectively. The chokes 32A, 32B control the tubing head pressure of the steam flowing through the short tubing string 16A and the long tubing string 16B in order to regulate the flow of the saturated steam flowing under pressure through the short tubing string 16A and the long tubing string 16B, respectively. The steam flows through both the short tubing string 16A and the long tubing string 16B and out the respective distal (outlet) ends 20, 22 and into the associated sections 13A, 13B of the horizontal portion 12C where the steam flows into the slotted liner of the horizontal portion 12C and exits through the slotted liner into the heavy oil reservoir 1 surrounding the slotted liner of the horizontal portion 12C. The injected steam produces a steam chamber surrounding the slotted liner of the horizontal portion 12C. Because the distal (outlet) end 20 of the short tubing string 16A is located proximal to the proximal end of the slotted liner of the horizontal portion 12C, the pressure of the steam exiting the distal (outlet) end 20 of the short tubing string 16A dictates the pressure of the steam in the interior space of the slotted liner over the heel section 13A of the horizontal portion 12C. Similarly, because the distal (outlet) end 22 of the long tubing string 16B is located at or near the distal end of the slotted liner of the horizontal portion 12C, the pressure of the steam exiting the distal (outlet) end 22 of the long tubing string 16B dictates the pressure of the steam in the interior space of the slotted liner over the toe section 13B of the horizontal portion 12C. These pressures influence the injection rate of steam that flows through the slotted liner into the heavy oil reservoir 1 over the heel section 13A and the toe section 13B of the horizontal portion.

At the edges of the steam chamber, heat transfer is accomplished by condensation of steam and conductive heat transfer, which reduces the viscosity of the heavy oil in this region and allows it to flow downward by gravity drainage through the slotted liner of the lower horizontal portion 14C of the production well 14, where it flows into the respective distal (inlet) ends 26, 29 and through the short tubing string 18A and long tubing string 18B to the surface with the aid of artificial lift mechanisms 33A, 33B (e.g., gas lift, progressing cavity pump, ESP). Because the distal (inlet) end 26 of the short tubing string 18A is located proximal to the proximal end of the slotted liner of the horizontal portion 14C, the short tubing string 18A tends to carry fluids produced from the heel section 15A of the horizontal portion 14C; although, if it is landed much further along, say towards the mid-region of horizontal portion 14C, then it may produce fluids entering the toe section 15B. Because the distal end 29 of the long tubing string 18B is located at or near the distal end of the slotted liner of the horizontal portion 14C, the long tubing string 18B tends to carry fluids produced from the toe section 15B of the horizontal portion 14C; although, if it is landed in a different position, say towards the mid-region of horizontal portion 14C, then it may produce fluids entering the heel section 15A. In this manner, the short and long tubing strings 18A, 18B are configured to carry fluids produced from associated sections 15A, 15B of the horizontal portion 14C of the production well 14.

The produced fluids are processed by a separation facility 34 that separates oil and water from the produced fluids. The water recovered by the separation facility 34 is treated by water treatment facility 36 (for example, involving separation/filtration of solids, deaeration, sulfate removal, softening, etc.) and supplied to the steam production facility 30.

According to the present application, a control system 42 is provided that employs separate PID control logic to independently control the interwell subcool temperatures for the corresponding injector-producer heel section pair (13A, 15A) and for the corresponding injector-producer toe section pair (13B, 15B). Specifically, PID control logic 1 (labeled 42A) is configured to control the interwell subcool temperature for the injector-producer heel section pair (13A, 15A), and PID control logic 2 (labeled 42B) is configured to control the interwell subcool temperature for the injector-producer toe section pair (13B, 15B). The control system 42 also includes artificial lift control logic 42C that is configured to control the operation of the artificial lift mechanisms 33A, 33B during production in order to lift produced fluids to the surface through the short tubing string 18A and long tubing string 18B, respectively. For example, where the artificial lift mechanisms 33A, 33B employ gas lift, the artificial lift control logic 42C can control valves that control the flow of injected gas into the respective tubing strings 18A, 18B. In another example, where the artificial lift mechanism employs progressing cavity pumps, the artificial lift control logic 42C can control the operation of the progressing cavity pumps to control the pumping action for the respective tubing strings 18A, 18B. In another example, where the artificial lift mechanism employs ESPs, the artificial lift control logic 42C can control the operation of the ESPs to control the pumping action for the respective tubing strings 18A, 18B. The PID control logic 1 (42A), the PID control logic 2 (42B) and the artificial lift control logic 42C can be realized by separate controllers or by a single controller performing distinct control operations. The controller(s) can be dedicated special purpose data processing system(s) or program general purpose data processing system(s) as is well known in the art.

The PID control logic 1 and 2 each calculate an "error" value as the difference between a measured process variable (in this case, the interwell subcool temperature for the associated injector-producer section pair) and a desired set point (in this case, the target subcool value), and attempt to minimize the calculated error by adjusting one or more control variables. The PID control logic 1 and 2 each employ a control function with a proportional term and associated proportional constant, an integral term and associated integral time constant, and a derivative term and an associated derivative time constant. The proportional term produces an output value that is proportional to the current respective error value. The integral term produces an output value that is proportional to the integral of the respective error value over time. The derivative term produces an output value that is proportional to the derivative of the respective error value at a given time. Heuristically, these values can be interpreted in terms of time: the proportional term depends on the present error, the integral term depends on the accumulation of past errors, and the derivative term is a prediction of future errors, based on current rate of change.

In one illustrative embodiment that includes dual tubing strings in both the injection well 12 and the production well 14, the PID control logic 1 controls the interwell subcool temperature for the injector-producer heel section pair (13A, 15A) based on the following formulation:

$$IR_1 = IR_{1t_s} + K_p\left(e_1(t) + \frac{\int_{t_s}^{t_e} e_1(t)\,dt}{T_i} - T_d\frac{d}{dt}e_1(t)\right) \quad \text{Eqn. 1(A)}$$

where $IR_1$, the adjusted control variable, is the injection rate into the short tubing string 16A of the injection well 12, which is dictated by operation of the control choke 32A;

$IR_{1t_s}$ is the initial injection rate into the short tubing string 16A of the injection well 12 (when the algorithm is started or reset), which is dictated by the initial state of the control choke 32A;

$K_p$ is a proportionality constant for all of the terms of the controller;

$K_p e_1(t)$ is the proportional term, which produces an output value that is proportional to the current error value;

$T_i$ is an integral time constant for the integral term $$\frac{K_p\int_{t_s}^{t_e} e_1(t)\,dt}{T_i},$$

which is proportional to the integral of error value over time;

$T_d$ is a derivative constant for the derivative term $$-K_p T_d\frac{d}{dt}e_1(t),$$

which is proportional to the derivative of the error value at a given time and is used to slow the rate of change of the controller output; particularly, the derivative time constant is used to reduce the magnitude of the overshoot produced by the integral term and improve the combined controller-process stability; and $e_1(t)$ is an error term representing the difference between the interwell subcool temperature for the injector-producer heel section pair (13A, 15A) and a given target subcool value ($T_{offset}$) at a given time.

The subcool temperature error term of Eqn. 1(A) is preferably calculated by subtracting the target subcool value ($T_{offset}$) from the measured interwell subcool temperature for the injector-producer heel section pair (13A, 15A) (which is given by the saturation temperature of the steam in the heel section 13A of the injection well 12 i.e., the temperature of steam in the heel section 13A of the injection well 12 corresponding to the measured pressure of the steam for the heel section of the injection well 12, minus the temperature of inflowing fluids to the heel section 15A of the production well 14) as follows:

$$e_1(t)=(T_{sat}(P_{inj,heelsection})-T_{producer,heelsection})-T_{offset} \quad \text{Eqn. 1(B)}$$

In this illustrative embodiment, the PID control logic 2 controls the interwell subcool temperature for the temperature for the injector-producer toe section pair (13B, 15B) based on the following formulation:

$$IR_2 = IR_{2t_s} + K_p\left(e_2(t) + \frac{\int_{t_s}^{t_e} e_2(t)\,dt}{T_i} - T_d\frac{d}{dt}e_2(t)\right) \quad \text{Eqn. 2(A)}$$

where $IR_2$, the adjusted control variable, is the injection rate into the long tubing string 16B of the injection well 12, which is dictated by operation of the control choke 32B;

$IR_{2t_s}$ is the initial injection rate into the long tubing string 16B of the injection well 12 (when the algorithm is started or reset), which is dictated by the initial state of the control choke 32B;

$K_p$ is a proportionality constant for all terms of the controller, $K_p e_2(t)$ is the proportional term, which produces an output value that is proportional to the current error value;

$T_i$ is an integral time constant for the integral term $$\frac{K_p\int_{t_s}^{t_e} e_2(t)\,dt}{T_i},$$

which is proportional to both the magnitude of the error and the duration of the error;

$T_d$ is a derivate time constant for the derivative term $$-K_p T_d\frac{d}{dt}e_2(t),$$

which is proportional to the derivative of the error term at a given time and is used to slow the rate of change of the controller output; particularly, the derivative time constant is used to reduce the magnitude of the overshoot produced by the integral component and improve the combined controller-process stability; and $e_2(t)$ is an error term representing the difference between the interwell subcool temperature for the injector-producer toe section pair (13B, 15B) and a given target subcool value ($T_{offset}$) at a given time.

The subcool error term of Eqn. 2(A) is preferably calculated by subtracting the target subcool value ($T_{offset}$) from the measured interwell subcool temperature for the injector-producer toe section pair (13B, 15B) (which is given by the saturation temperature of the steam in the toe section 13B of the injection well 12, i.e., the temperature of steam in the toe section 13B of the injection well 12 corresponding to the measured pressure of the steam for the toe section of the injection well 12, minus the temperature of inflowing fluids to the toe section 15B of the production well 14) as follows:

$$e_2(t)=(T_{sat}(P_{inj,toesection})-T_{producer.toesection})-T_{offset} \quad \text{Eqn. 2(B)}$$

PID control logic 1 generates an electrical control signal based on the adjusted control variable $IR_1$ and outputs the electrical control signal for communication to the control choke 32A. This electrical control signal dictates operation of the control choke 32A of tubing string 16A in order to vary the injection rate of steam into the tubing string 16A. The injection rate for the control choke 32A is adjusted in a manner that minimizes the interwell subcool error term of Eqn. 1(A) over time.

PID control logic 2 generates an electrical control signal based on the adjusted control variable $IR_2$ and outputs the electrical control signal for communication to the control choke 32B. This electrical control signal dictates operation of the control choke 32B of tubing string 16B in order to vary the injection rate of steam into the tubing string 16B. The injection rate for the control choke 32B is adjusted in a manner that minimizes the interwell subcool error term of Eqn. 2(A) over time.

The artificial lift control 42C operates independently of the PID control logic 1 and 2. For example, the artificial lift control 42C can control the artificial lift mechanisms 33A, 33B to produce fluids from the production tubing strings 18A, 18B at a constant rate during production irrespective of the derived subcool error terms.

A discrete form of Eqns. 1(A) and 2(A) can be used by the PID control logic 1 and 2. The control operations carried out by PID control logic 1 and 2 improve the uniformity of the steam chamber in the vicinity of the injection well 12 because the separate control schemes operate on different corresponding parts of the injection and production wells in attempting to achieve the specified subcool target $T_{offset}$.

The PID control logic 1 and 2 each accomplish two important things although they use a single error term. First, by helping each injector-producer section achieve a target subcool, the steam is used more efficiently. Since the production well sections 15A and 15B are cooler than the corresponding sections 13A and 13B of the upper injector when the target subcool is achieved or almost achieved, steam will tend to rise up into the steam chamber rather than flowing downward to be wastefully produced in the production well since steam flows most easily to the highest mobility region of the reservoir. If the region around and above the injector is hotter than the region nearer the producer, steam will want to rise up even though the producer pressures may be slightly lower than injection pressures. In this case, buoyancy or gravity effects outweigh the pressure differences between injector and producer. Secondly, each injector-producer section, in this case the heel section and the toe section for a dual tubing string configuration, are both simultaneously achieving or almost achieving the same target subcool. Therefore uniformity of production along the entire length of the well pair is enhanced. When all injector-producer sections are successfully meeting their targeted subcools, then production in all of the sections must be uniform, otherwise the non-uniformity of production will be almost-instantly reflected in a non-uniform subcool and the controller will act to remove the discrepancy.

The parameters and constants of Eqns. 1(A), 1(B), 2(A), and 2(B) can vary for different reservoirs. The parameters and constants of Eqns. 1(A), 1(B), 2(A), and 2(B) can also be updated over time during production of a given reservoir. For example, early in the SAGD production process, the subcool target $T_{offset}$ can be larger than later in time during the SAGD production process. In this example, the subcool target $T_{offset}$ can be decreased over time when the SAGD process has developed further. In one illustrative embodiment, the proportionality constant, $K_p$, of Eqns. 1(A) and 2(A) was chosen to have a numeric value of 10. This represents a significant gain over the temperature differences in the error term of Eqns. 1(B) and 2(B). This higher gain was selected in order to be responsive to sudden temperature rises of inflowing production fluids, as when steam breakthrough first occurs. A value of 50 days was chosen for the integral time constant $T_i$. A value of 0.001 was chosen for $T_d$. Consequently the derivative term contribution in Eqns. 1(A) and 2(A), is much less than the proportional and integral terms. These parameters are extremely process dependent. They are also amenable to optimization.

The control operations carried out by the PID control logic 1 and 2 can include additional filters, such as:

(i) if the injection rate for the respective injection tubing 16A, 16B exceeds a corresponding threshold maximum injection rate, the injection rate dictated by the control choke of the respective injection tubing 16A, 16B is set to the corresponding threshold maximum injection rate;

(ii) if the injection rate for the respective injection tubing 16A, 16B is less than a corresponding threshold minimum injection rate, the injection rate dictated by the control choke of the respective injection tubing 16A, 16B is set to the corresponding threshold minimum injection rate;

(iii) if the change of injection rate for the respective injection tubing 16A, 16B exceeds a corresponding threshold maximum level, the injection rate dictated by the control choke of the respective injection tubing 16A, 16B is set to the corresponding threshold maximum level; and (iv) if the change of injection rate for the respective injection tubing 16A, 16B is less than a corresponding threshold minimum level, the injection rate dictated by the control choke of the respective injection tubing 16A, 16B is set to the corresponding threshold minimum level.

The filter (iii) protects against a sudden change in injection rate that might occur before the integral term in Eqns. 1(A) and 2(A) has built up.

The PID control operations carried out by PID control logic 1 and PID control logic 2 can be commenced after a startup phase where saturated steam is supplied to the tubing strings 16A, 16B as well as to the tubing strings 18A, 18B (contrary to their normal SAGD operation as production tubing strings) without PID control. In this phase, the steam flows through the tubing strings 16A, 16B as well as through the tubing strings 18A, 18B where it is injected into the heavy oil reservoir 1 through the slotted liners of both horizontal portions 12C, 14C, respectively. This startup phase can last for a long period of time (for example, 60 days). It can be used to preheat heavy oil reservoir 1 in the vicinity of the horizontal portion 12C of injection well 12 and the vicinity of the horizontal portion 14C of production well 14 for the purpose of establishing hot communication. Both the injection well 12 and the production well 14 can be opened during this startup phase so that some of the circulating steam may enter the reservoir and reservoir fluids may be produced. Subsequently, after the startup phase, the upper well portion 12C becomes an injector, the lower well portion 14C becomes a producer and the PID control operations described above are commenced. At the end of the start-up phase, there can be non-uniformity in temperature and fluid distribution of the steam chamber around the injector portion 12C and the producer portion 14C due to reservoir heterogeneity and small pressure gradients within the wells. The PID control operations described above are effective in reducing the temperature non-uniformity (as well as fluid distribution non-uniformity) of the steam chamber over time as steam is injected into heavy oil reservoir 1 in the vicinity of injection well portion 12C and fluids are produced from the producer portion 14C.

For the case where the interwell subcool temperature error term is based upon the saturation temperature of the heel section 13A or toe section 13B of the injection well 12 as described above in Eqns. 1(B) and 2(B), the pressure for the heel or toe section can be derived from a measurement of well pressure at a location at or near the corresponding section of the injection well 12. The measured pressure can be used as input to a look-up table ("steam table") that provides the saturation temperature of steam in the injection well as a function of pressure in the injection well. Such pressure measurement can be realized by a bubble tube pressure gauge, quartz pressure transducer, or other pressure sensor suitable for the high temperate environment of the injection well 12. The pressure for the heel or toe section can also be derived by averaging pressure measurements distributed over the length of the heel or toe section of the horizontal portion 12C of the injection well 12. Such distributed pressure measurements can be measured by fiber optic pressure transducers, bubble tubes, or quartz transducers distributed along the corresponding length of the heel or toe section (or the full length) of the horizontal portion 12C of the injection well 12. In some cases, a measurement of well pressure at a location at or near the heel section 13A of the injection well 12 can be used to characterize the pressure of both the heel section 13A and the toe section 13B of the injection well 12. In these cases, a bubble tube pressure gauge (or other pressure sensor suitable for the high temperate environment of injection well 12) can be located at or near the distal end 20 of the short tubing segment 16A (which is located proximal and near the proximal end of the slotted liner of the horizontal portion 12C) in order to measure well pressure near the proximal end of the slotted liner of the horizontal portion 12C. This measured pressure can be used to characterize the pressure of both the heel section 13A and the toe section 13B. This characterization can lead to errors in the event that there are significant variations in well pressure along the interior space of the slotted liner of the horizontal portion 12C.

The temperature of inflowing fluids to the heel section 15A and toe section 15B, respectively, of the production well 14 can be derived from a multipoint thermocouple bundle, distributed fiber optic temperature sensor, or other suitable distributed temperature sensor capable of measuring temperature at different points along the length (or any partial length) of the horizontal section 14C of the production well 14. In one embodiment, the temperature of inflowing fluids to the heel section 15A is measured by averaging a number of temperature measurements distributed over the length of heel section 15A of the production well 14, and the temperature of inflowing fluids to the toe section 15B is measured by averaging a number of temperature measurements distributed over the length of toe section 15B of the production well 14. The temperature sensor(s) are preferably deployed as near as possible to the producing section, such as near the top of the slotted liner of horizontal section 14C or using a buckled instrument string. This ensures that any temperature gradient across the horizontal section 14C of the production well 14 can be identified and accounted for.

The injection (outflow) rate of the stimulating fluid that is flowing into and/or through the slotted liner of the horizontal portion 12C of the injection well 12 can be measured by one or more flow meters and supplied to the PID control logic 1 and 2 for feedback control of such injection rates. For example, flow meters can be located in the tubular strings 16A, 16B of the injection well 12. In another example, flow meters can be located downhole (preferably inside the slotted liner) and positioned at various points along the horizontal portion 12C of the injection well 12 to monitor injection rates of stimulating fluid through the slotted liner along the entire length or any partial length of the horizontal portion 12C of the injection well 12. In yet another example, a fiber optic flow meter can be located downhole (preferably inside the slotted liner) and extend along the entire length of the horizontal portion 12C of the injection well 12 to monitor injection rates of stimulating fluid through the slotted liner along the entire length or any partial length of the horizontal portion 12C of the injection well 12. In these examples, the injection rate of stimulating fluid through the slotted liner of the heel section 13A can be measured by averaging a number of outflow rate measurements distributed over the length of heel section 13A of the injection well 12, and the injection rate of stimulating fluid through the slotted liner of the toe section 13B can be measured by averaging a number of outflow rate measurements distributed over the length of toe section 13B of the injection well 12. Alternatively, the PID control logic 1 and 2 can calculate the injection rate of stimulating fluids through the slotted liner of the respective sections of the horizontal portion 12C of the injection well 12 based upon characterization of the control chokes 32A, 32B for such feedback control.

Figure 3A:
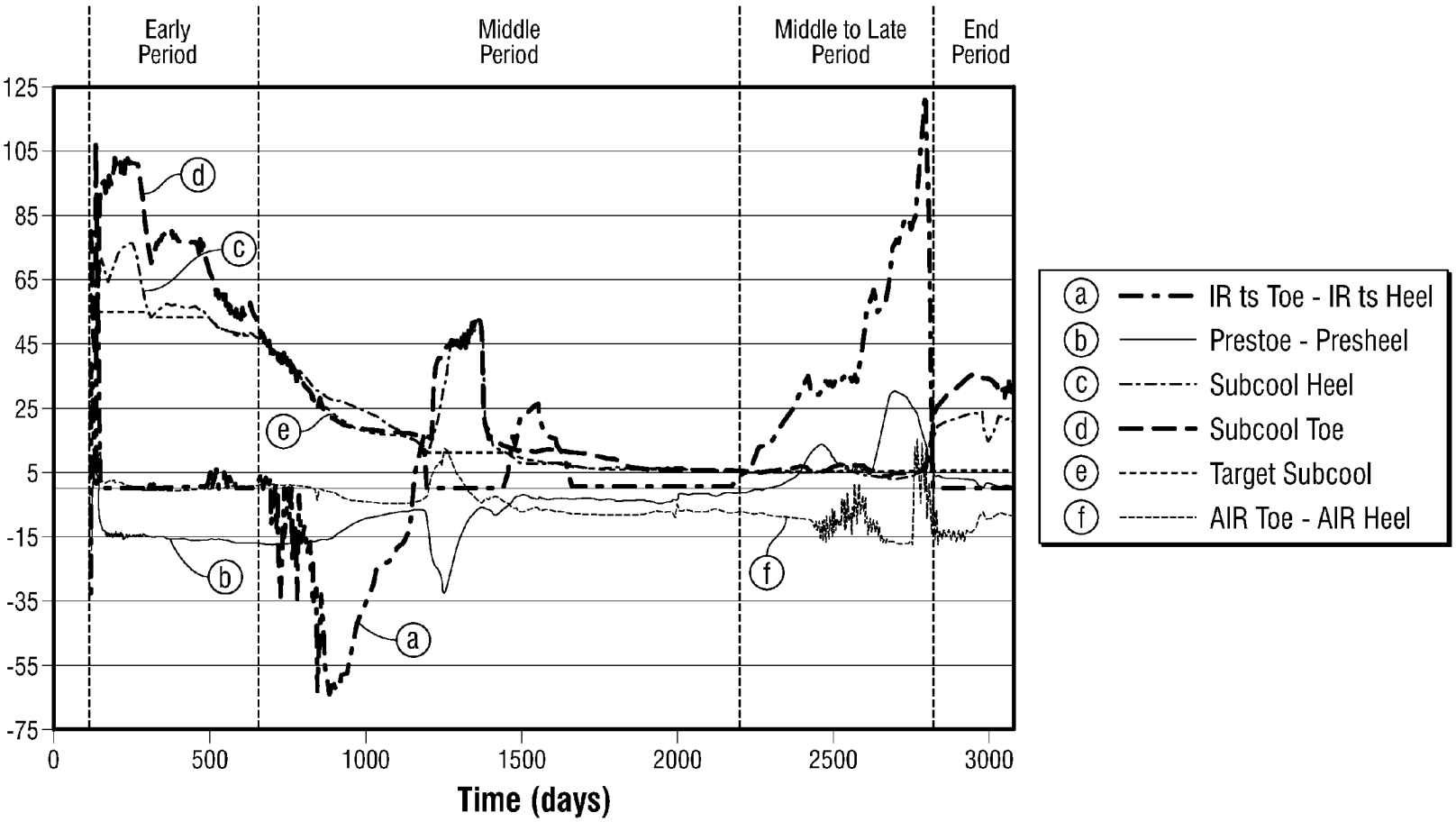
FIGS. 3A and 3B are graphs that illustrate various physical parameters throughout a hypothetical multi-year production cycle of a SAGD system under active feedback control in accordance with the present application.
Figure 3B:
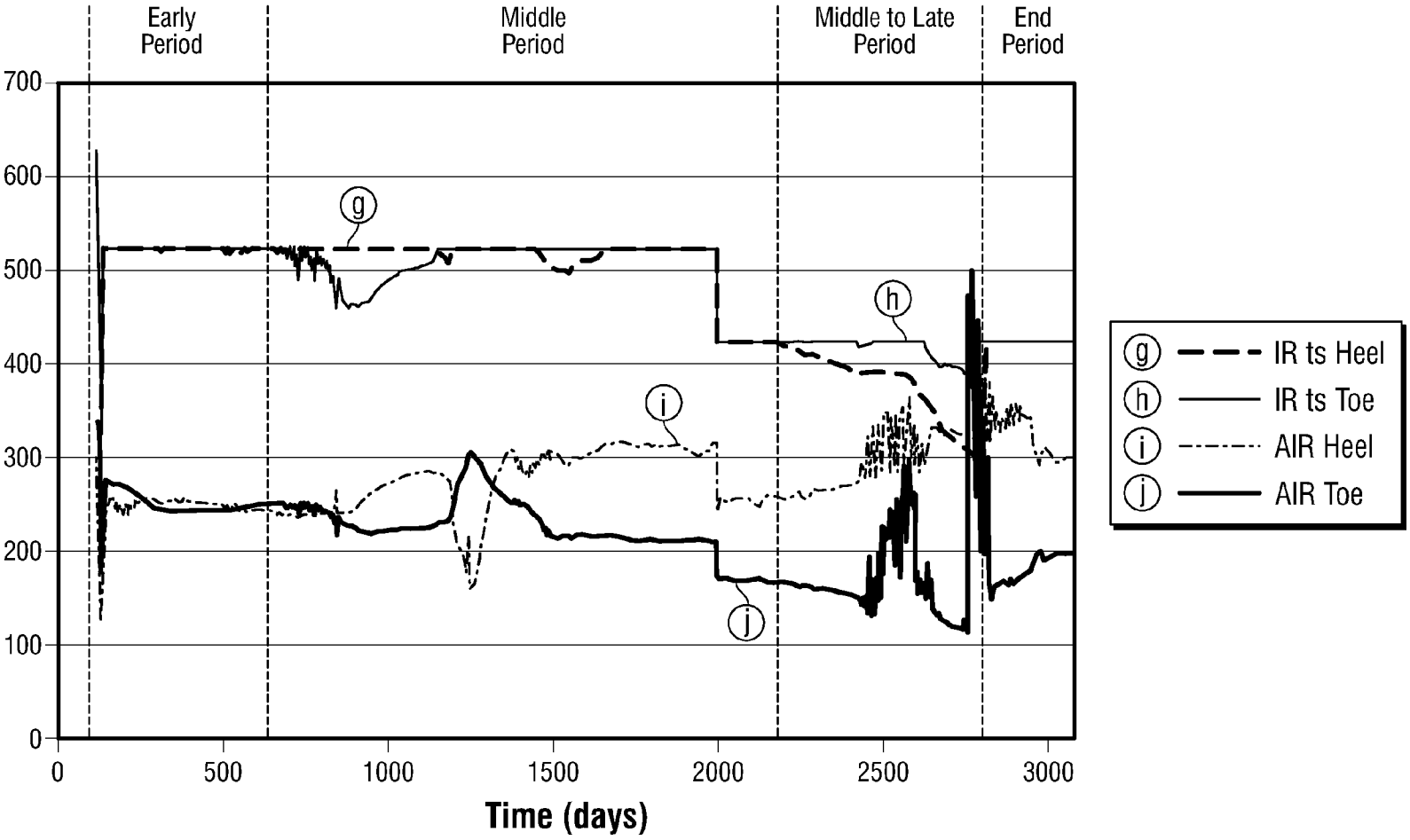

FIGS. 3A and 3B are graphs that illustrate various physical parameters throughout a hypothetical multi-year production cycle of an exemplary SAGD well pair under active feedback control as described above. Both upper injection well and lower production well have two tubing strings. The first is landed at the toe, the second at the heel. Units are not given for this data since trends are being discussed here. There are adjoining SAGD well pairs that are not under PID control. These adjoining well pairs begin to influence the production cycle of this well pair around 2200 days and by 2800 days, steam chambers have merged significantly and the PID controller of this well pair is no longer able to effectively maintain the subcools. The reservoir contains bitumen with an ultra-high dead-oil viscosity of 1.7 million cP in addition to methane and water. Steam is being injected at 60% quality. Reservoir permeability and porosity are quite heterogeneous. Permeability ranges from 1-4 Darcys, porosity from 25 to 35%. It is a well-known fact that in reservoirs of this type with extremely heavy oil, high permeability and high permeability/porosity heterogeneity, steam flow paths can be established that are hard to break and this often leads to very non-uniform production along the length of a SAGD well pair.

FIG. 3B shows plots of the actual injection rates into the tubing strings and actual injection rates from the well to the reservoir. The plots of "IR ts Heel" and "IR ts Toe" are injection rates from the tubing string landed at the heel and the tubing string landed at the toe respectively. The plots of "AIR Heel" and "AIR Toe" are injection rates from the well through the slotted liner into the reservoir and are averaged over the toe and heel halves of the injection well.

In FIG. 3A, the first parameter plotted is the difference between the toe and heel tubing string injection rates (labeled "IR ts Toe-IR ts Heel"). When this is nonzero, the PID control logic for the respective injection tubing strings is adjusting the relative injection rates in the injection tubing strings. The second parameter, "Prestoe-Presheel", is the difference in toe region and heel region reservoir pressures near the well. The third and fourth parameters, "Subcool Heel" and "Subcool Toe", are the subcools or temperature differences between injected and produced fluids, again averaged over the heel and toe halves of the well pair. The fifth parameter, "Target Subcool", is the target subcool which begins at 33° C. and reduces over time to 3° C. The sixth parameter, AIR Toe-AIR Heel, is the difference in injection rates from well to reservoir between the toe half and the heel half of the injection well.

Referring to FIG. 3B, the maximum injection rate of the tubing strings is reduced at 2000 days to a lower rate and both tubing strings operate at these maximal rates for periods during the production cycle. Often, only one or the other of the injection tubing strings is not operating at the maximum rate and these are periods when the controller is active. For example, between ~600 and 1200 days, the controller is adjusting the toe injection rates far more than the heel injection rates. Between 2200 and 2700 days, both injection rates are changing.

The injection rates from well to reservoir in the lower curves labeled AIR Heel and AIR Toe do not necessarily conform at all to injection rates from the tubing strings inside the well. The ability to inject steam into the reservoir is almost completely dependent on the mobility of reservoir fluids. Injection pressure inside the upper injector is roughly constant along the entire length of the well.

In FIG. 3A, a comparison of the difference in reservoir pressure, "Prestoe-Presheel", and injection into the reservoir, "AIR Toe-AIR Heel", shows that injection tends to take place into the toe region of the reservoir when the pressure is higher in the heel region than in the toe, and vice versa, or to put it another way, these two curves are out of phase.

Early Period: 100-700 Days

In FIG. 3A, the heel and toe subcools and the target subcool show that the PID control logic is unable to force the toe and heel subcools to meet the target until ~700 days. Prior to this, the PID control logic is making attempts to do so with brief periods where IR ts Toe-IR ts Heel is nonzero, and during these times the subcools are getting closer to the target, for example around 500 days, but do not reach it. These brief periods when the PID control logic is acting, although tubing string injection rates are not too different from each other, are nonetheless important for beginning to even out steam flow paths in the interwell region and promote more uniform production.

There are several reasons why the PID control logic is unable to force the subcools to the target in this time period: (i) mobility of reservoir fluids near to and in the interwell region are still non-uniform due to both uneven heating of the fluids in this region and reservoir permeability and porosity heterogeneity, and (ii) the PID control parameters are not optimized for reservoir conditions in this period but, rather, have been set in heuristic manner and remain constant throughout the production cycle.

Notice that the target subcool is much higher during this period. In this interval, temperature differences are largest between the upper injector and lower producer. The target subcool gradually reduces over time. If the target subcool were initially set to a low value, tubing string injection rates would always be at a maximum during this period which tends to establish steam flow paths between the upper injector and lower producer which then become hard to break. By allowing the PID control logic to work earlier to even out the subcools in the toe and heel regions, these hard-to-break flow paths are not allowed to establish themselves.

Note that steam injection from well to reservoir, AIR Toe-AIR Heel, is approximately zero so that injection is even.

Middle Period: 700-2200 Days

In this time period, the PID control logic is roughly successful at maintaining the heel and toe subcools to the target value. This target has reduced to almost the final value of approximately 5° C. However, from 1200 to 1400 days, the PID control logic is unable to operate effectively and the subcools during this period are quite far from the target.

Referring to FIG. 3B, the AIR Heel decreases sharply during this period while the AIR toe increases, hence in the upper figure, AIR Toe-AIR Heel in FIG. 3A becomes significantly greater than zero. Several reasons exist for this including: (i) the PID control logic is unable to act due to user-specified limits or filters (maximum tubing string injection rate, maximum change in injection rates—see the discussion of filters in paragraph 0046); (ii) reservoir conditions which appear to indicate that injectivity and mobility in the heel interwell region has drastically reduced compared to that in the toe; and (iii) the presence of a hard-to-move bank of low mobility fluid (oil and liquid water). In a heterogeneous reservoir, reservoir conditions may tend to change in this fashion when banks of lower mobility fluids temporarily become established at some region in the interwell area and are then difficult to move. It appears that a bank of lower mobility fluid has become lodged somewhere in the heel interwell region during this time period. For the rest of this interval, injection into the heel region has been restored (see FIG. 3B AIR Heel), subcools are being met and the well pair is efficiently producing oil and other reservoir fluids while maintaining a good steam-oil ratio.

The dramatic effect of the PID control logic is demonstrated when it is unable to act during this time interval.

Middle to Late Period: 2200-2800 Days

During this time interval, the adjoining SAGD well pairs are beginning to influence this well pair. Although steam chambers have not yet merged, temperature profiles are nonetheless beginning to merge which is causing the controller to work much harder to maintain the heel and toe subcools at the target. It can be seen in both FIGS. 3A and 3B that the tubing string injection rates are not operating at all near the maximal rates and the difference between the heel and toe rates is also very large (refer to "IR ts Heel" and "IR ts Toe" in FIG. 3B and "IR ts Toe-IR ts Heel" in FIG. 3A). In spite of working much harder, the PID control logic is able to enforce the subcools successfully and the well pair is still efficiently producing oil and other reservoir fluids.

Unlike earlier periods of time, actual injection from well to reservoir is tending increasingly towards the toe and this corresponds to (is in phase with) tubing string injection. Pressures in the toe reservoir region are also higher than the heel, only decreasing somewhat when actual injection attempts to take place in the toe half of the injector. Pressures in the reservoir are also beginning to reflect the tubing string injection inside the well, i.e. are increasingly becoming in phase with this injection which, in turn, is an added benefit to the PID control logic because the PID control logic can more directly influence the fluid movement in the interwell region and out into the steam chamber through controlling the pressure gradient in the direction of the well axis.

End Period: 2800-3100 Days

In this period, steam chambers from the adjoining SAGD well pairs have merged with that of the present well pair, and the PID control logic is no longer able to act on the subcools and these subcools are quite different than the target. Tubing string injection rates have both returned to maximum indicating that the PID control logic is not operating.

Note that in the Middle to Late Period of the production cycle, reservoir pressure gradients are becoming increasingly in phase with the difference in tubing string injection rates between the toe and heel. This, in turn, gives the PID control logic greater ability to control pressure gradients in a direction along the well axis, both in the interwell region and out further into the steam chamber.

The independent PID control operations described above can be extended for other multiple string SAGD completions. For example, one or more additional injection tubing strings can be deployed in the injection well 12, and/or one or more additional production tubing strings can be deployed in the production well 14. For example, an intermediate length injector tubing string can be deployed such that its distal end is disposed inside the slotted liner of the horizontal portion 12C of the injection well 12 intermediate the distal end of the short tubing string 16A and the distal end of the long tubing string 16B, and an intermediate length production tubing string can be deployed such that its distal end is disposed inside the slotted liner of the horizontal portion 14C of the production well 14 intermediate the distal end of the short tubing string 18A and the distal end of the long tubing string 18B. In this case, the horizontal portion 12C of the injection well 12 is logically partitioned into three sections (a heel section, an intermediate section, and a toe section). Similarly, the horizontal portion 14C of the production well 14 is logically partitioned into three sections (a heel section, an intermediate section, and a toe section) which correspond to the sections of the horizontal portion 12C of the injection well 12. The short, intermediate, and long tubing strings of the injector well 12 are configured to supply steam to associated sections (heel section, intermediate section, toe section) of the horizontal portion 12C of the injection well 12. The short, intermediate, and long tubing strings of the production well 14 are configured to carry produced fluids from associated sections (heel section, intermediate section, toe section) of the horizontal portion 14C of the production well 14. Additional pressure measurements and steam saturation temperature calculations for the intermediate section of the injection well 12 are carried out. Additional fluid inflow temperature measurements for the intermediate section of the production well 14 can also be carried out. Additional PID control logic utilizes these measurements to derive and output an electrical control signal that is communicated to the control choke for the intermediate injection tubing string, which dictates operation of the control choke for the intermediate injection tubing string in order to vary the injection rate of steam into the intermediate injection tubing string. The injection rate for the intermediate injection tubing string is varied to control the interwell subcool temperature for the injector-producer intermediate section pair in a manner that minimizes the subcool error term for the injector-producer intermediate section over time. Similar configurations can be utilized to partition the horizontal portions of the injection well and the production well to four or more sections.

It is also contemplated that the PID control operations of the interwell subcool temperature across the injector-producer section pairs can involve control over the artificial lift devices of the production tubing strings. For example, correcting for subcool errors where the measured interwell subcool temperature for a given injector-producer section pair is greater than the target subcool can involve controlling the artificial lift device for the producing section of the corresponding injector-producer section pair to decrease the flow rate of produced fluids from the production well section, and correcting for subcool errors where the measured interwell subcool temperature for a given injector-producer section pair is less than the target subcool can involve controlling the artificial lift device for the producing section of the corresponding injector-producer section pair to increase the flow rate of produced fluids from the production well section. The inflow rates of produced fluids can be measured by one or more flow meters and supplied to the PID control logic for feedback control of such inflow rates. For example, flow meters can be located in the tubular strings of the production well 14. In another example, flow meters can be located downhole and positioned at various points along the horizontal portion 14C of the production well 14 to monitor inflowing rates of produced fluids along the entire length or any partial length of the horizontal portion 14C of the production well 14. In yet another example, a fiber optic flow meter can be located downhole and extend along the entire length of the horizontal portion 14C of the production well 14 to monitor inflowing rates of produced fluids along the entire length or any partial length of the horizontal portion 14C of the production well 14. In these examples, the inflow rate of produced fluids into the heel section 15A can be measured by averaging a number of inflow rate measurements distributed over the length of heel section 15A of the production well 14, and the inflow rate of produced fluids into the toe section 15B can be measured by averaging a number of inflow rates distributed over the length of toe section 15B of the production well 14. The downhole flow meter(s) are preferably deployed as near as possible to the producing section, such as near the top of the slotted liner 14C or using a buckled instrument string. This ensures that inflow rates, alone, are being measured and the inflow rates do not include any co-mingling with other wellbore fluids. Alternatively, the PID control logic can calculate the flow rate of produced fluids based upon characterization of the artificial lift devices for such feedback control.

Figure 4A:
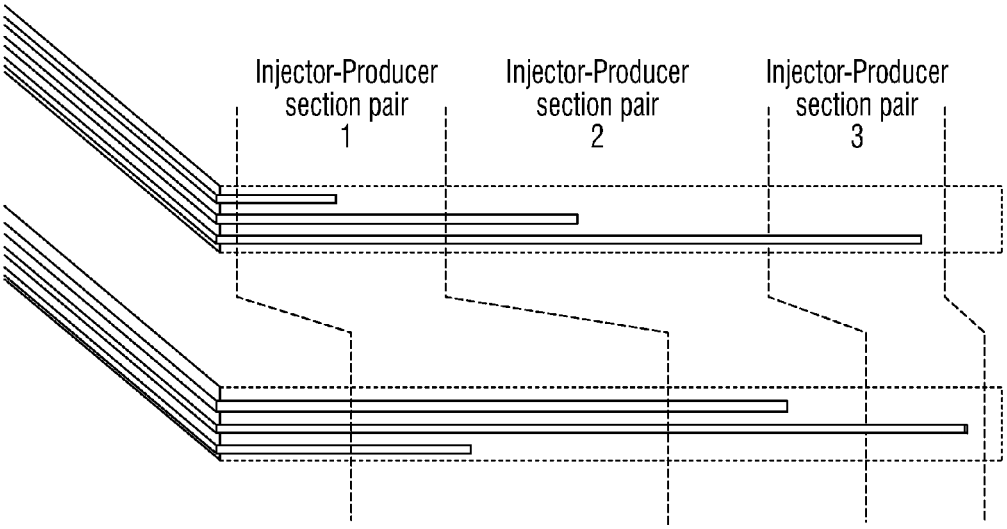
FIGS. 4A and 4B are schematic diagrams of an injector segment and a producer segment at two different times $T_1$ and $T_2$, where various injector-producer section pairs have been specified, each of which contains the end of an injection or production tubing string, and where the boundaries of these various injector-producer section pairs are changing with time.
Figure 4B:
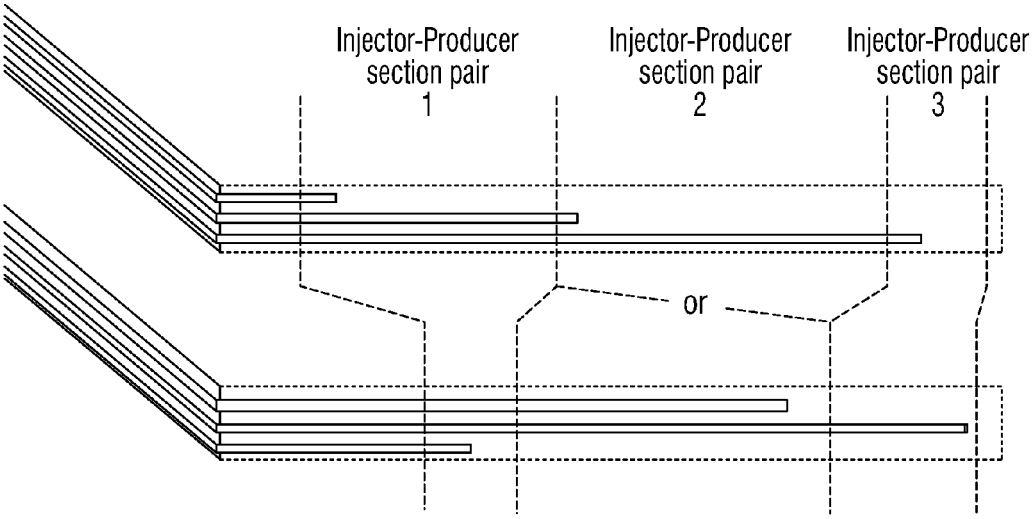

It is also contemplated that the boundaries of the injection-production section pairs (and thus the logical partitioning of the injection-production section pairs) may change in time. FIGS. 4A and 4B show a horizontal injection-production well pair. Within the injection well and production well of this configuration are three tubing strings, the first landed somewhere in the heel region of the respective well, the second landed somewhere in the mid region of the respective well and the third landed somewhere in the toe region of the respective well. At a time $T_1$, the injector-producer pair boundaries are defined as shown in FIG. 4A. Later at a second time $T_2$, the boundaries of the three injecter-producer section pairs has changed somewhat as shown in FIG. 4B. Also, for certain time intervals, these boundaries may merge. For example, the second injector-producer section is shown to be possibly (the word "or" is used) merged with that of the third injector-producer section at the time period $T_2$. These boundaries can be chosen by the operator. In each of the injector-producer sections, the actual subcool is calculated by averaging temperatures in the injector length of the given section, and then subtracting an average temperature of produced fluids in the producer length of this given section. The operator may wish to change the lengths of the sections or to merge them in order to concentrate the injection to correct a stubborn problem with either subcool, water cut, or other measured quantity that is being used in the error term of the controller.

In other alternative embodiments, other fluids (such as hydrocarbon solvents) capable of reducing the viscosity of the heavy oil of the reservoir can be injected into the upper injection well to enhance production of fluids from the lower production well. In yet another embodiment, other techniques such as in situ heating and fire flooding, can be used to reduce the viscosity of the heavy oil of the reservoir to enhance production of fluids from the lower production well. In these embodiments, the independent PID control operations of the tubing strings of the injection well and/or production well can be extended to control properties of the injection well and/or production well.

Other well designs can be used. For example, the upper portion of the first wellbore can extend generally in a horizontal direction and the lower portion of the second wellbore can extend in an inclined manner under the upper portion of the first wellbore. This design is commonly referred to as a J-well Assisted Gravity Drainage (JAGD) design. In addition, the well may contain lateral branches, which can be planned or side-tracks from the existing horizontal leg. In each of the branches or side-tracks, multiple tubing strings can be used and injector-producer sections for each controller as described above.

The downhole temperature and/or pressure sensors described herein can be part of an instrument string located inside or outside the slotted liner of the respective injection or production well. The instrument string can be disposed inside a tubular that extends along the inside or outside of the slotted liner of the respective injection or production well or integrated into the tubular itself.

Moreover, one or more observation wells can intersect the trajectory of the horizontal injector portion 12C and the horizontal producer portion 14C within a short distance from these portions. The observation well(s) can be outfitted with temperature sensors for monitoring the temperature of the horizontal injector portion 12C and the horizontal producer portion 14C at the point of intersection. For example, an observation well can intersect the heel section 13A of the horizontal injector portion 12C and the heel section 15A of horizontal producer portion 14C within a short distance of such heel sections in order to monitor the temperature of the respective heel sections 13A, 15A. Similarly, an observation well can intersect the toe section 13B of the horizontal injector portion 12C and the toe section 15B of horizontal producer portion 14C within a short distance of such toe sections in order to monitor the temperature of the respective toe sections 13B, 15B. These temperature measurements can be part of the error term of the respective controllers and can be given a weighting factor and can be used to adjust the boundaries of the injector-producer sections. For example, if a temperature observation well observes a cooler region of the steam chamber away from the well pair, then the operator may decide to use that criterion temporarily to override the subcool target, or reduce it, also to change boundaries of the injector-producer sections, in order to concentrate injection on correcting that problem.

In alternative embodiments, the independent PID control operations of the tubing strings of an injection well and production well can be extended to control other measured process variables of the injection well and/or production well, such as the gas-oil ratio (GOR), steam-oil ratio (SOR), or water-cut at any point in a production well. Water-cut is the ratio of water produced compared to the volume of total liquids produced. For example, the error term of the respective controllers can be modified to include other quantities besides the difference between actual interwell subcool and target subcool. For example, if the water cut is measured by a downhole flow meter to be much higher than desired, then the water cut can be included in the error term of the PID controller with a weighting factor such that either it can be the sole error term or it can be weighted together with the subcool to calculate a mixed error term. Similar adaptations can be made for GOR or SOR. Note that the subcool criterion will improve SOR in any event. As stated above, the operator may want to intervene and change the weighting of various terms in the controller error term. For example, weighting factors can be associated with various contributions to the error term of the respective controller as follows:

$$e_{section\ i}(t)=\alpha_1(\text{measured subcool}_{section\ i}-\text{target subcool}_{section\ i})+$$

$$\alpha_2(\text{measured water cut}_{section\ i}-\text{target watercut}_{section\ i})+$$

$$\alpha_3(\text{measured GOR}_{section\ i}-\text{target GOR}_{section\ i})+$$

$$\alpha_4(\text{measured SOR}_{section\ i}-\text{target SOR}_{section\ i}). \quad \text{Eqn. 3}$$

$\alpha_1$, $\alpha_2$, . . . are weighting factors for the various contributions to the error term. The GOR target may be used to control methane production, for example, the SOR target to control steam production, for example.

There have been described and illustrated herein several embodiments of a method, apparatus and system for recovering hydrocarbons from a subterranean reservoir employing an injection well and production well having multiple tubing strings with active feedback control. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its scope as claimed.

What is claimed is:

1. A system for producing fluids from a subterranean hydrocarbon reservoir comprising:

an injection well and a production well that traverse the hydrocarbon reservoir, wherein the injection well includes an injector segment that is completed with at least one slotted liner and the production well includes a producer segment that is completed with at least one slotted liner, wherein the injector segment of the injection well is positioned in the hydrocarbon reservoir above and generally parallel to the producer segment of the production well, wherein the injector segment of the injection well is logically partitioned into a plurality of sections and the producer segment of the production well is logically partitioned into a plurality of sections that correspond by relative location to the sections of the injector segment to define a plurality of injector-producer section pairs;

a plurality of injection tubing strings for the sections of the injector segment, wherein each injection tubing string is configured to supply stimulating fluid to an associated section of the injector segment where the stimulating fluid flows into the at least one slotted liner of the injector segment and exits through the at least one slotted liner into the hydrocarbon reservoir in the vicinity of the injector segment of the injection well;

a plurality of surface-located control devices that control head pressure of stimulating fluid flowing through the respective injector tubing strings in order to regulate the flow of stimulating fluid flowing through the injection tubing strings;

a plurality of production tubing strings for the sections of the producer segment, wherein each production tubing string is configured to carry fluids produced from an associated section of the producer segment of the production well; and a plurality of controllers for the injector-producer section pairs, wherein each controller is configured to control at least one process variable for 2 value associated with the at least one process variable of the corresponding injector-producer section pair over time, wherein the error value is used in a control function processed by the given controller, wherein the control function is configured to minimize the error value over time by adjusting, a control variable over time, and wherein the adjusted control variable is used to control the surface-located control device for the injector tubing string that supplies stimulating fluid to the injector section of the associated injector-producer section pair.

2. The system according to claim 1, wherein the control function processed by the given controller includes a first term, a second term and a third term, wherein the first term produces an output value that is proportional to the current error value, wherein the second term produces an output value that is proportional to the integral of the error value over time, and wherein the third term produces an output value that is proportional to the derivative of the error value at a given time.

3. The system according to claim 1, wherein the error value calculated by each given controller is based upon a calculation wherein a target subcool temperature is subtracted from a process variable representing, a measured interwell subcool temperature.

4. The system according to claim 1, wherein the error value calculated by each given controller is based upon a calculation involving a plurality of process variables and associated weight factors.

5. The system according to claim 4, wherein the plurality of process variables includes one process variable representing a measured interwell subcool temperature.

6. The system according to claim 5, wherein the plurality of process variables includes at least one other process variable representing a measured operation parameter selected from the group consisting of water-cut, Gas-Oil Ratio (GOR), and Steam-Oil Ratio (SOR).

7. The system according to claim 1, wherein:

the injection tubing strings extend from the surface through the injection well and terminate at internal locations of the injection well that are spaced apart from one another within or near the associated section of the injector segment of the injection well; and the production tubing strings extend from the surface through the production well and terminate at internal locations of the production well that are spaced apart from one another within or near the associated section of the producer segment of the production well.

8. The system according to claim 7, wherein:

the sections of the injector segment include at least a heel section and a toe section, wherein the proximal end of the heel section of the injector segment is defined by the proximal end of the at least one slotted liner of the injector segment, and wherein the distal end of the toe section of the injector segment is defined by the distal end of the at least one slotted liner of the injector segment;

the sections of the producer segment include at least a heel section and a toe section, wherein the proximal end of the heel section of the producer segment is defined by the proximal end of the at least one slotted liner of the producer segment, and wherein the distal end of the toe section of the producer segment is defined by the distal end of the at least one slotted liner of the producer segment;

the injection tubing strings include a short injection tubing string and a long injection tubing string, wherein the short injection tubing string supplies stimulating fluid to the heel section of the injector segment and terminates at an internal location of the injection well at or near the proximal end of the heel section of the injector segment, and wherein the long injection tubing string supplies stimulating fluid to the toe section of the injector segment and terminates at an internal location of the injection well at or near the distal end of the toe section of the injector segment; and the production tubing strings include a short production tubing string and a long production tubing string, wherein the short production tubing string carries fluids produced from the heel Section of the producer segment and terminates at an internal location of the production well at or near the proximal end of the heel section of the producer segment, and wherein the long production tubing string carries fluids produced from the toe section of the producer segment and terminates at an internal location of the production well at or near the distal end of the toe section of the producer segment.

9. The system according to claim 1, wherein the hydrocarbon reservoir includes heavy oil and the plurality of injection tubing strings are configured to supply saturated steam to the associated sections of the injector segment where the steam exits through the at least one slotted liner of the injector segment into the heavy oil reservoir in the vicinity of the injector segment of the injection well in order to contribute to steam chamber development within the heavy oil reservoir.

10. The system according to claim 1, further comprising at least one flow meter that is configured to measure flow associated with the injector well, wherein the at least one flow meter is used for feedback control of the surface-located control devices of the respective injection tubing strings.

11. The system according to claim 1, wherein the injector segment of the injection well extends generally in a horizontal direction, and the producer segment of the production well extends in an inclined manner under the injector segment of the injection well.

12. The system according to claim 1, wherein;

the control function processed by the given controller has the form:

$$IR = IR_{t_s} + K_p\left(e(t) + \frac{\int_{t_s}^{t_e} e(t)\,dt}{T_i} - T_d\frac{d}{dt}e(t)\right)$$

where IR is a control variable that is used to control a surface-located control device for an associated injector tubing string;

$IR_{t_s}$ is an initial state of the control variable IR;

$K_p e(t)$ is the first term, where $K_p$ is a proportionality constant for the first term;

$$\frac{K_p\int_{t_s}^{t_e} e(t)\,dt}{T_i}$$

is the second term, where $T_i$ is an integral time constant for the second term;

$$-K_p T_d\frac{d}{dt}e(t)$$

is the third term, where $T_d$ is a derivative time constant for the third term; and e(t) is the error value of the control function at a given time, and represents the difference between the interwell subcool temperature of an associated injector-producer section pair and a target subcool temperature value at a given time.

13. The system according to claim 1, wherein boundaries of the sections of the injector-producer section pairs vary over time.

14. The system according to claim 13, wherein the boundaries of the sections of the injector-producer section pairs are varied over time according to user input.

15. In a system that produces fluids from a subterranean hydrocarbon reservoir traversed by an injection well and a production well, wherein the injection well includes an injector segment that is completed with at least one slotted liner and the production well includes a producer segment that is completed with at least one slotted liner, wherein the injector segment of the injection well is positioned in the hydrocarbon reservoir above and generally parallel to the producer segment of the production well, wherein the injector segment of the injection well is logically partitioned into a plurality of sections and the producer segment of the production well is logically partitioned into a plurality of sections that correspond by relative location to the sections of the injector segment to define a plurality of injector-producer section pairs, wherein a plurality of injection tubing strings are configured to supply stimulating fluid to associated sections of the injector segment where the stimulating fluid flows into the at least one slotted liner of the injector segment and exits through the at least one slotted liner into the hydrocarbon reservoir in the vicinity of the injector segment of the injection well, and wherein a plurality of production tubing strings are configured to carry fluids produced from associated sections of the producer segment of the production well, a production control method comprising:

employing, a plurality of surface-located control devices that are configured to control head pressure of stimulating fluid flowing through the respective injection tubing strings in order to regulate the flow of stimulating fluid flowing through the injection tubing strings; and employing a plurality of controllers for the injector-producer section pairs, wherein each controller is configured to control at least one process variable for one of the injector-producer section pairs over time, wherein each given controller calculates an error value associated with the at least one process variable of the corresponding injector-producer section pair over time, wherein the error value is used in a control function processed by the given controller, wherein the control function is configured to minimize the error value over time by adjusting a control variable over time, and wherein the adjusted control variable is used to control the surface-located control device for the injection tubing string that supplies stimulating fluid to the injector section of the associated injector-producer section pair.

16. The method according to claim 15, wherein the control function processed by the given controller includes a first term, a second term and a third term, wherein the first term produces an output value that is proportional to the current error value, wherein the second term produces an output value that is proportional to the integral of the error value over time, and wherein the third term produces an output value that is proportional to the derivative of the error value at a given time.

17. The method according to claim 15, wherein the error value calculated by each given controller is based upon a calculation wherein a target subcool temperature is subtracted from a process variable representing a measured interwell subcool temperature.

18. The method according to claim 15, wherein the error value calculated by each given controller is based upon a calculation involving a plurality of process variables and associated weight factors.

19. The method according to claim 18, wherein the plurality of process variables includes one process variable representing a measured interwell subcool temperature.

20. The method according to claim 19, wherein the plurality of process variables includes at least one other process variable representing a measured operation parameter selected from the group consisting of water-cut, Gas-Oil Ratio (GOR), and Steam-Oil Ratio (SOR).

21. The method according to claim 15, wherein:

the injection tubing strings extend from the surface through the injection well and terminate at internal locations of the injection well that are spaced apart from one another within or near the associated section of the injector segment of the injection well; and the production tubing strings extend from the surface through the production well and terminate at internal locations of the production well that are spaced apart from one another within or near the associated section of the producer segment of the production well.

22. The method according to claim 21, wherein:

the sections of the injector segment include at least a heel section and a toe section, wherein the proximal end of the heel section of the injector segment is defined by the proximal end of the at least one slotted liner of the injector segment, and wherein the distal end of the toe section of the injector segment is defined by the distal end of the at least one slotted liner of the injector segment;

the sections of the producer segment include at least a heel section and a toe section, wherein the proximal end of the heel section of the producer segment is defined by the proximal end of the at least one slotted liner of the producer segment, and wherein the distal end of the toe section of the producer segment is defined by the distal end of the at least one slotted liner of the producer segment;

the injection tubing strings include a short injection tubing string and a long injection tubing string, wherein the short injection tubing string supplies stimulating fluid to the heel section of the injector segment and terminates at an internal location of the injection well at or near the proximal end of the heel section of the injector segment, and wherein the long injection tubing string supplies stimulating fluid to the toe section of the injector segment and terminates at an internal location of the injection well at or near the distal end of the toe section of the injector segment; and the production tubing strings include a short production tubing string and a long production tubing string, wherein the short production tubing string carries fluids produced from the heel section of the producer segment and terminates at an internal location of the production well at or near the proximal end of the heel section of the producer segment, and wherein the long production tubing string carries fluids produced from the toe section of the producer segment and terminates at an internal location of the production well at or near the distal end of the toe section of the producer segment.

23. The method according to claim 15, wherein the hydrocarbon reservoir includes heavy oil and the plurality of injection tubing strings are configured to supply saturated steam to the associated sections of the injector segment where the steam exits through the at least one slotted liner of the injector segment into the heavy oil reservoir in the vicinity of the injector segment of the injection well in order to contribute to steam chamber development within the heavy oil reservoir.

24. The method according to claim 15, further comprising:

configuring at least one flow meter to measure stimulating fluid flow associated with the injection well; and controlling the surface-located control devices of the respective injection tubing strings based on feedback provided by the at least one flow meter.

25. The method according to claim 15, wherein:

the control function processed by the given controller has the form:

$$IR = IR_{t_s} + K_p\left(e(t) + \frac{\int_{t_s}^{t_e} e(t)\,dt}{T_i} - T_d\frac{d}{dt}e(t)\right)$$

where IR is a control variable that is used to control a surface-located control vice for an associated injector tubing string;

$IR_{t_s}$ is an initial state of the control variable IR;

$K_p e(t)$ is the first term, where $K_p$ is a proportionality constant for all terms of the control function;

$$\frac{K_p\int_{t_s}^{t_e} e(t)\,dt}{T_i}$$

is the second term, where $T_i$ is an integral time constant for the second term;

$$-K_p T_d\frac{d}{dt}e(t)$$

is the third term, where $T_d$ is a derivative time constant for the third term; and e(t) is the error value of the control function at a given time, and represents the difference between the interwell subcool temperature of an associated injector-producer section pair and a target subcool temperature value at a given time.

26. The method according to claim 15, wherein boundaries of the sections of the injector-producer section pairs vary over time.

27. A method according to claim 26, wherein the boundaries of the sections of the injector-producer section pairs are varied over time according to user input.

* * * * *